US009359760B2

(12) United States Patent
Miller et al.

(10) Patent No.: US 9,359,760 B2
(45) Date of Patent: Jun. 7, 2016

(54) CONCRETE FLOORING

(71) Applicant: COR ENGINEERING LIMITED, Tarporley, Cheshire (GB)

(72) Inventors: Fergus Ronald Miller, Wilmslow (GB); Stephen Gerard Peter Blundell, Bramhall (GB)

(73) Assignee: COR ENGINEERING LIMITED (GB)

( * ) Notice: Subject to any disclaimer, the term of this patent is extended or adjusted under 35 U.S.C. 154(b) by 0 days.

(21) Appl. No.: 14/367,830

(22) PCT Filed: Jan. 4, 2013

(86) PCT No.: PCT/EP2013/050124
§ 371 (c)(1),
(2) Date: Jun. 20, 2014

(87) PCT Pub. No.: WO2013/102672
PCT Pub. Date: Jul. 11, 2013

(65) Prior Publication Data

US 2014/0360116 A1 Dec. 11, 2014

(30) Foreign Application Priority Data

Jan. 4, 2012 (GB) ..... 1200033.7

(51) Int. Cl.
*E04G 11/04* (2006.01)
*E04H 15/20* (2006.01)
*E04B 5/23* (2006.01)
(Continued)

(52) U.S. Cl.
CPC . *E04B 5/23* (2013.01); *B28B 7/186* (2013.01); *B28B 7/32* (2013.01); *B28B 23/0025* (2013.01); *E04B 5/043* (2013.01); *E04B 5/326* (2013.01); *B28B 21/88* (2013.01); *B28B 23/0006* (2013.01);
(Continued)

(58) Field of Classification Search
CPC ..... E04H 15/20; E04H 2015/204; B28B 7/32; B28B 23/0006; B28B 21/88; E04B 1/169
USPC ..... 52/650.3, 340, 220.5, 341, 223.6, 294, 52/577, 576, 2.18; 249/183, 178, 1; 264/71; 138/105, 111, 115, 89, 89.1, 138/93
See application file for complete search history.

(56) References Cited

U.S. PATENT DOCUMENTS 1,520,840 A * 12/1924 Murray ..... 264/336
2,299,111 A 10/1942 Rogers et al.
(Continued)

FOREIGN PATENT DOCUMENTS

CN 2536676 Y 3/2002
CN 201217874 Y 4/2009
(Continued)

OTHER PUBLICATIONS

PCT/EP2013/050124—International Search Report dated May 3, 2013.
(Continued)

*Primary Examiner* — Chi Q Nguyen
(74) *Attorney, Agent, or Firm* — Quarles & Brady LLP; Gavin J. Milczarek-Desai

(57) ABSTRACT

An improved concrete floor arrangement is formed from a single cast piece or alternatively a plurality smaller cast pieces linked together to form a floor surface. The floor is arranged in the form of a grid.

8 Claims, 4 Drawing Sheets

(51) Int. Cl.

| | |
|---|---|
| ***E04B 5/04*** | (2006.01) |
| ***E04B 5/32*** | (2006.01) |
| ***B28B 7/32*** | (2006.01) |
| ***B28B 7/18*** | (2006.01) |
| *E04B 1/16* | (2006.01) |
| *B28B 21/88* | (2006.01) |
| *B28B 23/00* | (2006.01) |

(52) U.S. Cl.
CPC ..... *E04B 1/169* (2013.01); *E04H 15/20* (2013.01); *E04H 2015/204* (2013.01)

(56) References Cited

U.S. PATENT DOCUMENTS

| | | | | |
|---|---|---|---|---|
| 2,325,254 | A * | 7/1943 | Lefebure | 52/241 |
| 2,485,898 | A * | 10/1949 | Mathews et al. | 249/65 |
| 3,030,687 | A * | 4/1962 | Muspratt | 264/71 |
| 3,104,441 | A * | 9/1963 | Smith | 249/183 |
| 3,213,581 | A | 10/1965 | Macchi | |
| 3,832,991 | A * | 9/1974 | Schlosser | 126/91 A |
| 3,908,323 | A * | 9/1975 | Stout | 52/99 |
| 3,950,902 | A * | 4/1976 | Stout | 52/91.2 |
| 3,999,333 | A * | 12/1976 | Amarantos | 52/2.19 |
| 4,037,375 | A | 7/1977 | Maggos et al. | |
| 5,762,152 | A * | 6/1998 | Foster et al. | 180/8.5 |
| 6,536,168 | B1 | 3/2003 | Cugini et al. | |
| 7,314,399 | B2 * | 1/2008 | Turner | 441/129 |
| 8,443,562 | B2 * | 5/2013 | Paul et al. | 52/295 |
| 2005/0051932 | A1 * | 3/2005 | Danzik | 264/511 |

FOREIGN PATENT DOCUMENTS

| | | | |
|---|---|---|---|
| GB | 1519402 | A | 7/1978 |
| GB | 2478739 | A | 9/2011 |
| JP | H0872048 | A | 3/1996 |
| JP | 2000045443 | A | 2/2000 |
| JP | 2003-27647 | | 1/2003 |
| JP | 2003027647 | A | 1/2003 |
| WO | 2005/124059 | A1 | 12/2005 |

OTHER PUBLICATIONS

UK IPO Search Report dated Jul. 5, 2013 in corresponding GB Application No. 1300139.1.
EPO Communication dated May 19, 2015 in corresponding EPO Application No. 13701211.8.
EPO Communication dated Oct. 27, 2015 in corresponding EPO Application No. 13701211.8.
CN First Office Action dated Nov. 3, 2015 in corresponding CN Application No. 201380004842.8.

* cited by examiner

CONCRETE FLOORING

TECHNICAL FIELD OF THE INVENTION

This invention relates to improvements in or relating to concrete floors and in particular to the creation of accessible void spaces within said floor structure which consequently produce a structurally efficient floor containing significantly less material

BACKGROUND OF THE INVENTION

The formation of void spaces in current concrete floor structures is thought to produce a benefit since such voids can be arranged to have functionality in a number of different advantageous ways. In order to resolve the issues which arise in relation to prior art of the kind being considered, the limitations of the system need to be overcome or at least minimised.

SUMMARY OF THE INVENTION

Limitations previously used have not had any significant effect in resolving any remaining issues which still remain unaddressed.

It is accordingly an object of the present invention to provide a concrete floor structure which overcomes or at least minimises the problems associated with the use of existing concrete floor solutions.

Thus and in accordance with the present invention, there is provided a concrete floor structure which comprises a framework enclosing side-by-side expandable tubular members, said expandable tubular members being expandable to an extent limited by the framework and wherein, said floor structure is restricted in its movement by the rigidity of the framework and forces said members to adopts a position in which they have a flattened top and/or bottom thereto.

With this arrangement it is possible to provide a concrete floor structure which causes a void to be created within the flooring which is accessible through an aperture, the aperture being capable of being easily closed off when required by insertion of a closure in the form of a plug.

Preferably, said floor structure is formed into a plurality of pre-assembled pieces which when placed adjacent to each other can be used to form a floor structure.

The floor structure may be formed as a single cast piece or can be formed as a number of smaller cast pieces which can be joined together in any suitable manner to form a single floor structure.

BRIEF DESCRIPTION OF THE INVENTION

The invention will now be described further by way of example only and with reference to the accompanying drawings in which.

It is instructive to consider the state of the art at the time that the present invention was devised and which, even at that time, it was possible to create a concrete floor used by casting.

Figure 1:
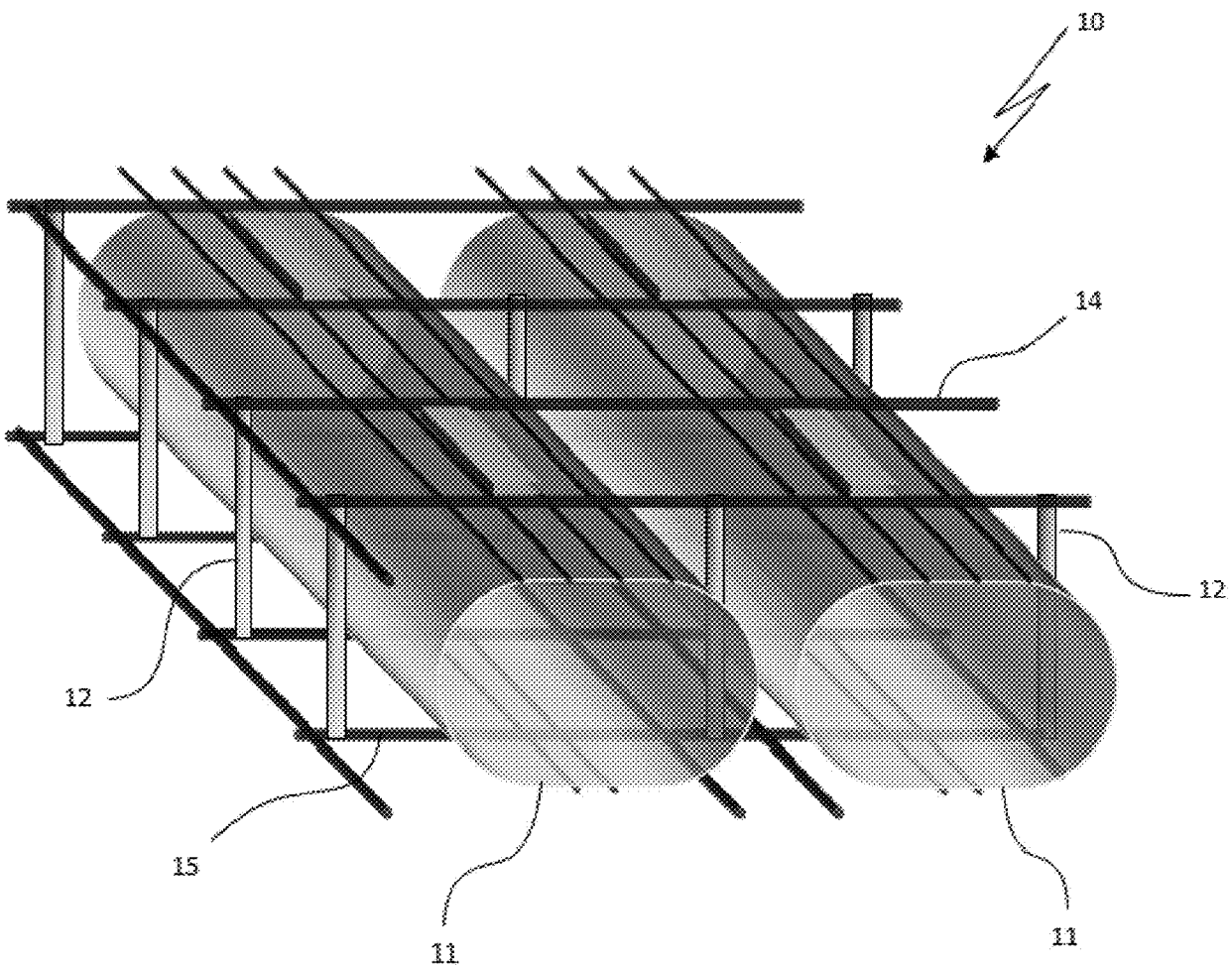
FIG. 1 shows one embodiment of flooring of the type of the present invention.

Referring now to the figures, FIG. 1 shows a first example of a method of construction of a suitable floor by way of a single casting of concrete in a single piece and with the single opening providing access to the interior of the voids. This type of concrete floor is referred to as "flat slab".

A second prior art form of a flooring of the type of the present invention has concrete cast for the purpose of use in this "hybrid concrete floor" in which the component parts are cast firstly and are then installed into the frame to form concrete walls and floor of a building.

Both of these types of concrete can accommodate and/or include a system in which the formation of voids is possible.

However, the concrete frames formed using the prior art systems described above cannot be installed so as to provide a desired shape of flooring which can then be accessed from externally of the floor. This is achieved by having an external plug that provides access to voids created in the flooring and this can be achieved by removing the plug. Once completed, the plug can be reinserted to close off the voids from the outside world.

Referring now to the drawings, there is shown in FIG. 1 a perspective view of one embodiment of concrete floor structure formed in accordance with the present invention.

The apparatus for constructing a concrete floor structure 10 shown in the drawings comprises side by side tubular members 11 which are held between upper 14 and lower 15 framework elements in the form of a mesh. The tubular members 11 are retained in position by restraint members 12 which fix the tubular members 11 in position prior to and when fully expanded. The restraint straps 12 comprise ends at the top and bottom thereof which engage with the top and bottom meshes and remain during the expansion by inflation of the tubular members 11. More particularly, the restraint straps 12 are formed generally in a curved configuration and when the tubular members 11 are expanded by inflation prior to supplying concrete to the structure; the restraint straps 12 retain the spatial positioning of the tubular members 11 in the floor structure apparatus 10. For clarity, it will be appreciated that the tubular members 11 form the voids as can be seen in a combination of FIGS. 1 to 3. It can be seen that the voids extend through the floor structure and eventually form an array in which access to at least a part of the floor of the structure is available.

Also, when the tubular members 11 expand, they expand against the surface of the mesh reinforcement frame until they adopt a truncated circular configuration. The fact that the tubular members 11 are restricted in the degree of expansion that can be achieved, it will inevitably mean that top and bottom surfaces will be truncated by expansion beyond the normal size of the void members.

The framework described herein consists preferably of a lightweight welded steel reinforcement mesh and the dimensions and appropriate spacing is determined by the particular concrete structure being utilised. The mesh reinforcement can be formed from any suitable material having the required strength and lightness to fulfil the functions required of it.

The tubular members 11 are contained within the framework, i.e. between the respective mesh layers prior to use. The void members are made from any impermeable material having the appropriate characteristics to enable it to perform its function. Thus, the extent of expansion may be different depending upon the material used. As can the adhesive strength of the void material or alternatively by the application of such material or coating to an external surface of the void material. The void members can be utilised to convey any suitable and non-corrosive material, for example liquids, gases, conduits or cables. The void members can respectively have a link to enable communication of these surfaces to specific areas of the floor, and the voids can be accessed during the building of the concrete floor.

Figure 2:
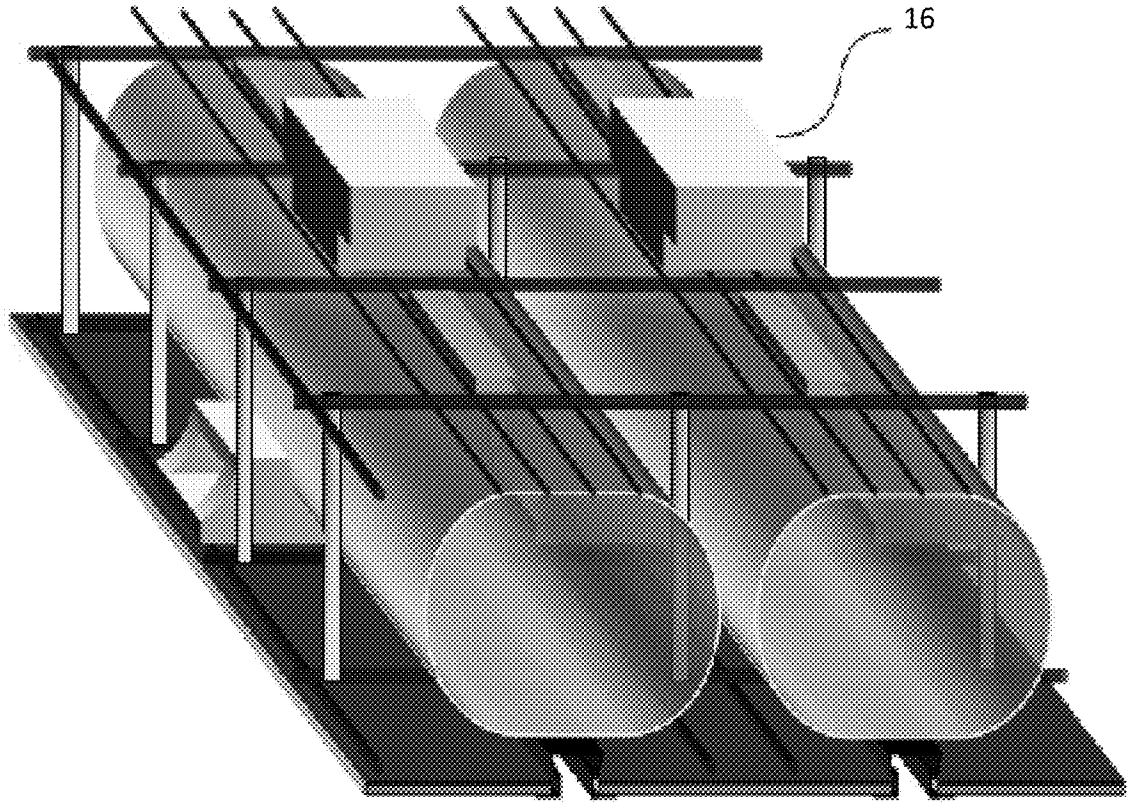
FIG. 2 shows the floor of FIG. 1 in which a plug and top hat device as described herein after.

A concrete floor showing the disposition and form of internal voids in the form of inter-connected hollow members which extend through the body of the floor as shown in FIGS. 1 and 2. The voids 11 extend through the floor and essentially form an array in which access to at least a part of the floor is possible due to the communication with the interior of the void space. The opening that allows services to be inserted into the arrangement is then closed by use of a plug which seals the interior of the void to the outside.

Whilst in the drawing shown, a generally circular cross-section of void space is utilised, it will be appreciated that the void could be of any particular shape, such as, rectangular, trapezium or cylindrical. The choice of which of the shape of void required is normally determined slowly by the size of the materials to be carried through the conduit. For example, the void spaces can allow transport of air, water, electrical and lighting system, and the arrangement must be of a form to deal with such problems.

The existing arrangement also includes some void space and may or may not be preassembled and/or stack packed in a condensed arrangement.

It is envisaged that the presence of a void 11 into which one or more service elements can be inserted is to great advantage for operators in particular those associated with air handling, power suppliers, along with water suppliers and IT suppliers, with ceiling services which need to be replaced can have new replacement components added where necessary. Other less important services are for example, lighting and sprinkler systems; there is also the possibility of using it to contain smoke detectors.

Referring now to FIG. 2, there is shown side-by-side void spaces of the type in accordance with the present invention. The construction shown in FIG. 2 provides a simple and effective manner of providing entry to the interior of the flooring by use of a hand operated plug 16 which can be removed to insert something into the void and then replaced so as to be sufficiently sealed off. This arrangement has been found to work much more efficiently and straightforwardly than arrangements of the known prior art.

Figure 3:
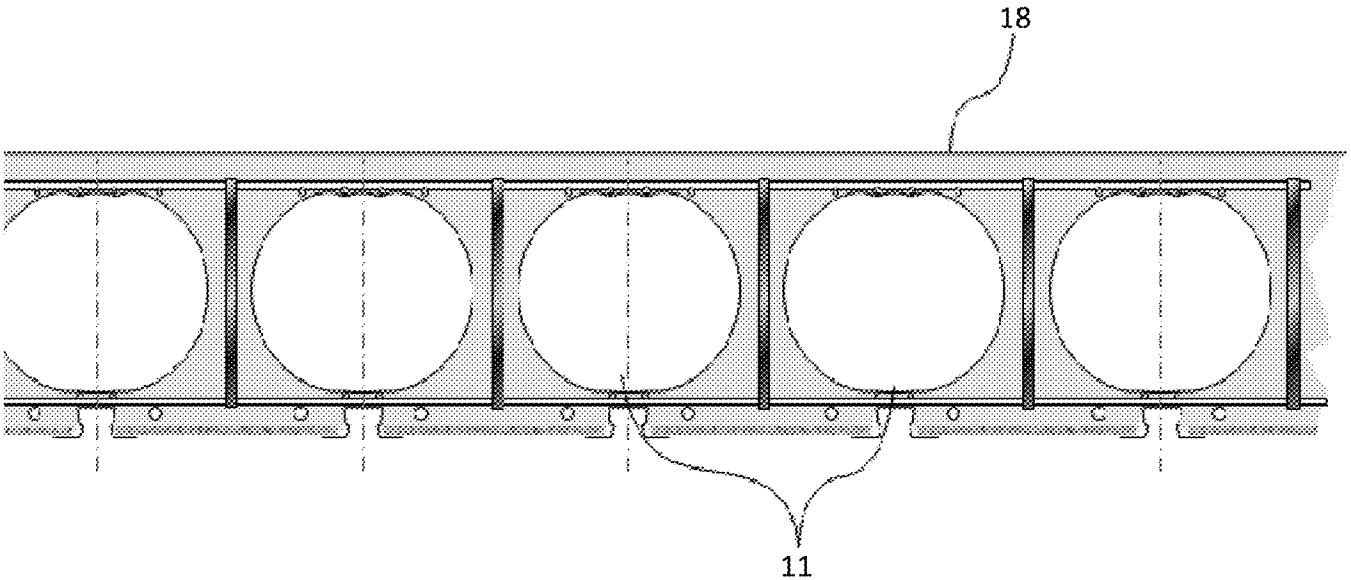
FIG. 3 shows a diagrammatic representation of a side view in accordance with the present invention.

FIG. 3 shows one embodiment of void formed in accordance with the present invention, The void consists of openings to allow access to the void space within the concrete floor structure 18. In use the system of the present invention has been found to be of significant flexibility in so far as additional nylon or steel wire ties, which are flexible, can be used to anchor the voids in position to prevent floatation occurring as a result of nylon or steel due to their flexible nature.

At the side, or both sides in some positions, respective support members ensure the integrity of the void structure and these are shaped to extent from the top to the bottom of the structure. The void (hollow member 11) can be formed from an impermeable material, which may give rise to the necessary features for this device. The void can be used to form a number of different kinds, for example, convey liquids, gases, conduits or cables or indeed any other articles which can be inserted into the void space.

The major improvement given by the present invention is the ability to access more readily the interior of the void and allow distribution of the services to be throughout the whole of the void and which allows ease of access and a wide variety of different access.

It is of course to be understood that the invention is intended to be restricted to the details of the above embodiment, which are described by way of example only.

Thus for example in FIG. 3, the cross sectional view of the formation of the voids can be seen. Also, the so called "top hat" features can be important for anchoring buoyancy, temporary span between prop lines, soffit panel support and a permanent fixing channel and conduit that may be utilised to access the void above.

Figure 4:
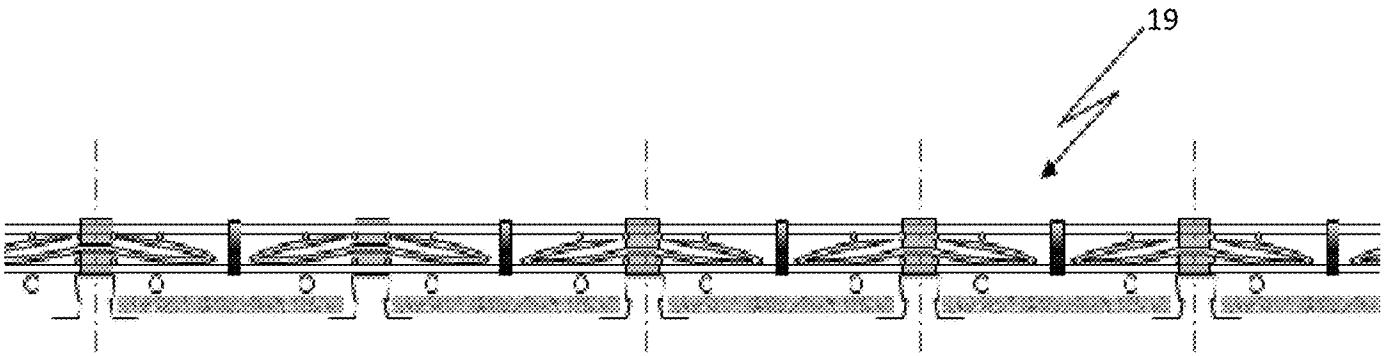
FIG. 4 shows a flat-pack form of the assembly.

Still further, the assembly can be supplied in a self-assembly or flat-pack form 19. An example of this is shown in FIG. 4.

The accessible voids, whether of an inflated type or preformed concrete form, involve the use of voids that will normally be cast in the concrete by use of in-situ concrete supply.

The pouring of concrete is made after the on-site grid link up has been completed. This is an important difference that can be drawn between prior art products that have non lined voids, preformed off site, such voids can comprise concrete hollow core units.

Other benefits that arise through use of the invention are for example:

1. It is possible to have a flat soffit
2. Reduction in the amount of material necessary to form the floor.
3. Reduction of the gravity loads on the frame and substructure of the floor.
4. Enhanced seismic performance of the floor.
5. Allows off-site construction with reduced waste and improved accuracy to permit greater installation speed.
6. Reduction in the required labour, overall site programme and costs.
7. Permits multiple mechanical and electrical servicing options including active thermal mass integration.
8. Significantly improved transportability, with in excess of 1000 $m^2$ of flooring transported by a single truck.

The invention claimed is:

1. A framework for constructing a concrete floor structure in-situ comprising a framework that is rigid and encloses a series of inflatable tubular members, the framework comprises upper and lower framework elements in a form of upper and lower layers of meshes, and wherein the framework further comprises restraint members that are engagable with said upper and lower framework elements, said inflatable tubular members being inflated to an extent limited by the rigidity of the framework such that said tubular members adopt a position of having a flattened top and bottom, and wherein inflation of the tubular members results in the engagement of the restraint members with the upper and lower framework elements to form said rigid framework.

2. The framework for constructing the concrete floor structure in-situ according to claim 1, wherein the framework provides reinforcement to the concrete floor structure.

3. The framework for constructing the concrete floor structure in-situ according to claim 1, wherein the framework is provided in the form of a flat pack.

4. The framework for constructing the concrete floor structure in-situ according to claim 1, wherein one or more of said inflatable tubular members is provided with one or more plugs to allow the formation of one or more apertures in a floor.

5. A concrete floor structure constructed using the framework for constructing a concrete floor according to claim 1.

6. A concrete floor structure constructed using the framework for constructing a concrete floor according to claim 1, wherein the floor structure is formed as a single cast piece or as a number of smaller cast pieces joined together in a suitable manner to form a single floor structure.

7. A concrete floor structure constructed using the framework for constructing a concrete floor according to claim 1, wherein a void is provided within the floor structure which is accessible through an aperture.

8. A concrete floor structure constructed using the framework for constructing a concrete floor according to claim 1, wherein a void is provided within the floor structure which is accessible through an aperture and wherein the aperture is closed off with a closure in the form of a plug.

* * * * *